United States Patent [19]

Hennequin

[11] 4,226,455

[45] Oct. 7, 1980

[54] LOCKING DEVICE FOR RAISABLE VENETIAN BLIND

[75] Inventor: Petrus J. Hennequin, Rotterdam, Netherlands

[73] Assignee: Hunter Douglas International N.V., Netherlands Antilles

[21] Appl. No.: 917,117

[22] Filed: Jun. 19, 1978

[30] Foreign Application Priority Data

Oct. 6, 1977 [DE] Fed. Rep. of Germany ..... 2744930

[51] Int. Cl.[2] ..... E05C 15/00

[52] U.S. Cl. ..... 292/345; 160/175

[58] Field of Search ..... 292/345; 160/173, 175, 160/178 R, 178 C

[56] References Cited

U.S. PATENT DOCUMENTS

| | | | |
|---|---|---|---|
| 390,392 | 10/1888 | Niss | 160/175 |
| 2,205,156 | 6/1940 | Rowley | 292/345 X |
| 2,243,910 | 6/1941 | Laborda | 160/175 X |
| 2,274,837 | 3/1942 | Lawson | 160/175 |
| 2,299,095 | 10/1942 | Knox | 160/175 X |
| 2,497,824 | 2/1950 | Reed | 160/175 |
| 2,643,712 | 6/1953 | Dunn | 160/178 R X |
| 3,130,777 | 4/1964 | Bonanno | 160/178 R |
| 3,952,789 | 4/1976 | Marotto | 160/178 C X |

*Primary Examiner*—J. Franklin Foss

*Attorney, Agent, or Firm*—Pennie & Edmonds

[57] ABSTRACT

This invention relates to a locking device for a raisable or liftable venetian blind in which the bottom rail of the venetian blind includes an end piece extending into and guided by the side housing of the blind and in which a flexible lifting member engages the end piece of the bottom rail to raise and lower the same. A spring urged pivoted latch is provided within the lower portion of the housing which automatically engages over the end piece of the bottom rail when it is in the lowered position and the tension in the lifting member is relaxed. Thus the blind is locked in the down position. When tension is applied to the lifting member to lift the blind, the lifting member moves the latch out of locking engagement with the end piece permitting the blind to be raised.

7 Claims, 3 Drawing Figures

LOCKING DEVICE FOR RAISABLE VENETIAN BLIND

BACKGROUND OF THE INVENTION

In venetian blinds, particularly when they are used externally of the window, it is frequently desirable that the same be locked in the lowered position in order to prevent rattling due to a strong wind and also for security purposes against possible unauthorized entry. It is also desirable that such a locking device be simple in construction and assembly for purposes of economy and equally as simple in operation. Additionally, such a locking device should preferably not require separate keys or the like which tend to become lost or misplaced.

BRIEF DESCRIPTION OF THE INVENTION

The present invention accomplishes the above-mentioned objectives by means of a pivoted latch mechanism positioned near the bottom of the enclosed housing on the side of the blind but spaced a predetermined and selectable distance above the bottom. When the blind is in its lowered position the bottom rail has its end piece extending into the housing adjacent the bottom thereof and the latch mechanism is so spaced from the bottom of the housing as to extend over the top of the end piece to lock the same in position when the lifting tape is relaxed. Upon grasping the lifting tape which usually extends through the wall of the housing into the exterior, the same becomes tensioned and bears against the latch in a cam like manner to move the latch against the urging of the spring out of engagement with the end piece so that the end piece may be raised and passed by the latch.

When the blind is lowered the end piece engages a sloping cam surface on the latch forcing the same out of the path of the end piece against the urging of the spring whereby the end piece of the bottom rail may pass thereby to its locked position. Upon relaxing the tension in the lifting tape the spring again urges the latch into locking position above the end piece.

BRIEF DESCRIPTION OF THE DRAWINGS

The construction and operation of the locking device of the present invention will be apparent to those skilled in the art from the following description and drawings in which:

As shown in FIG. 1 a raisable venetian blind generally indicated at 1 includes a top rail housing 2, a side housing 13, and plurality of horizontally positioned slats 10. The venetian blind 1 also includes a bottom rail 11 having an end piece 12 which includes a longitudinally extending neck member 14 which passes through a slot 15 in the housing 13 to the interior of the housing 13. The neck piece 14 is guided by the slot 15 during raising and lowering of the blind by virtue of its loose-sliding engagement therewith.

Figure 1:
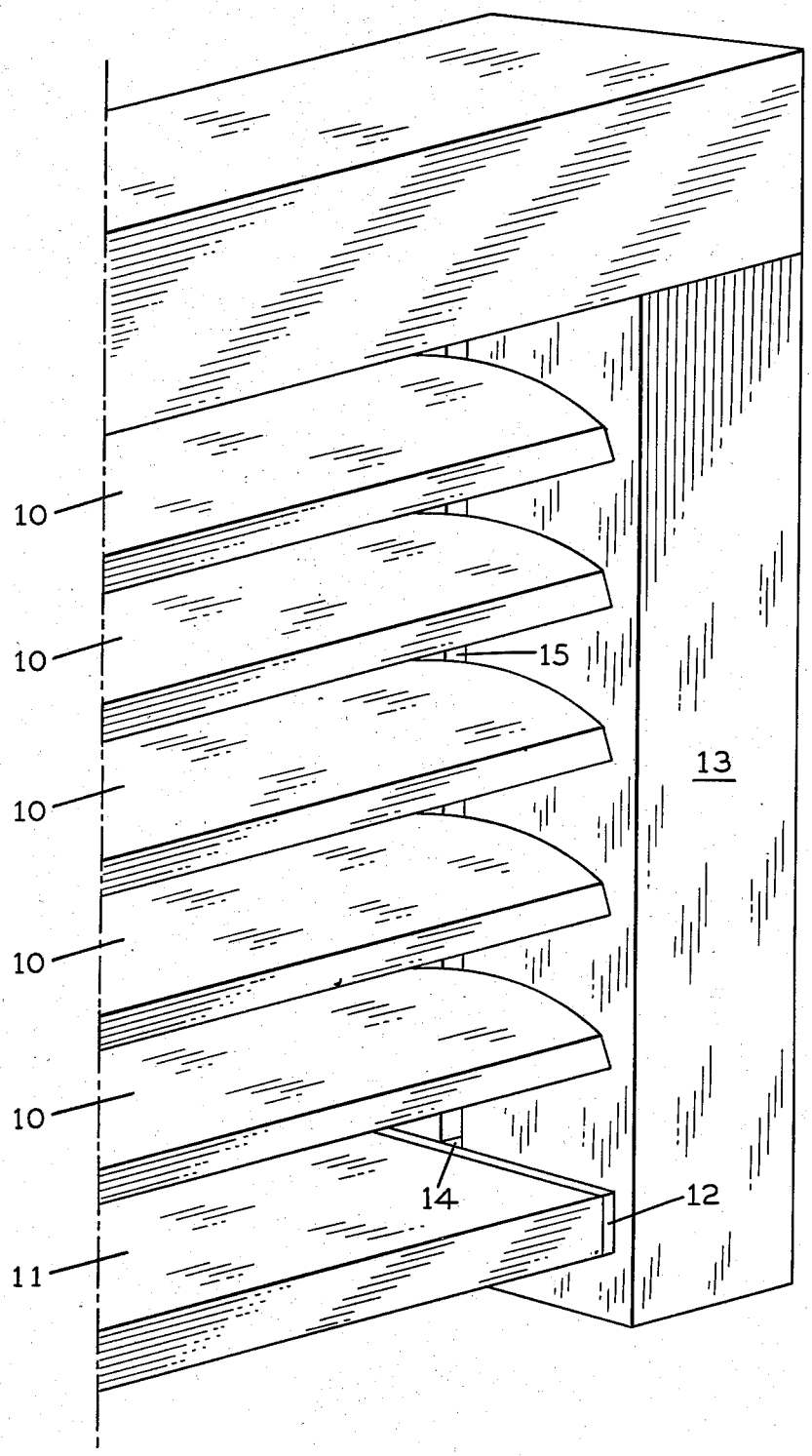
FIG. 1 shows a partial perspective view of the right side of a venetian blind.
Figure 2:
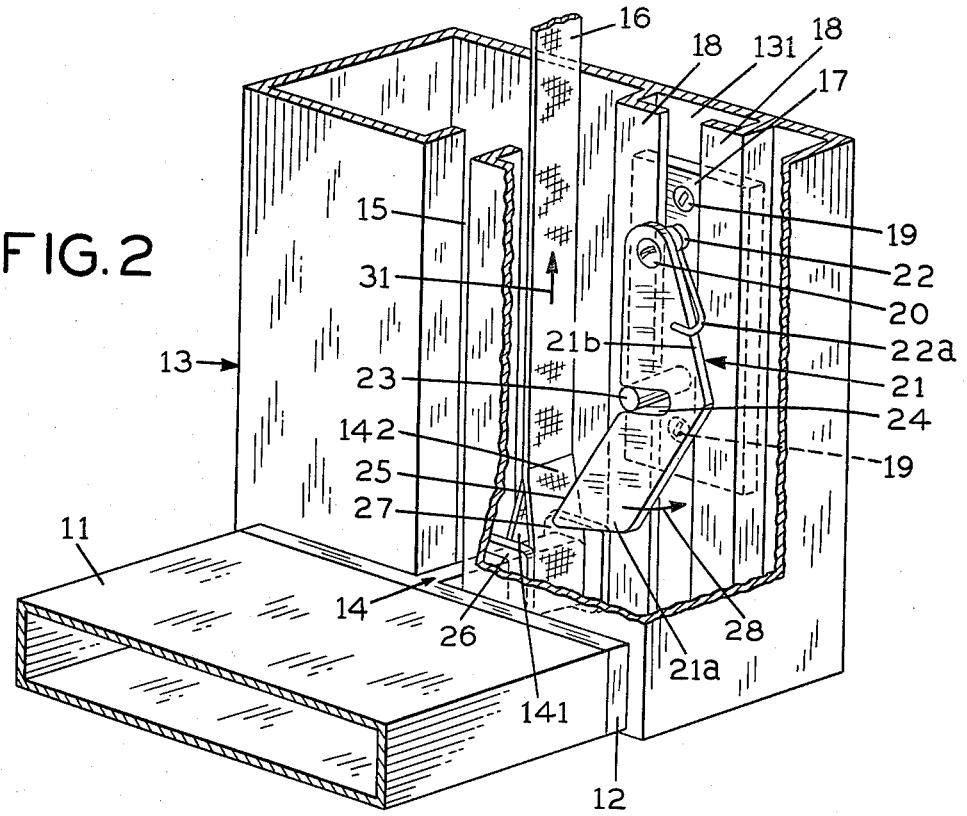
FIG. 2 shows an enlarged broken away view of the lower right-hand corner of the blind housing and end piece of the bottom rail during raising of the blind.
Figure 3:
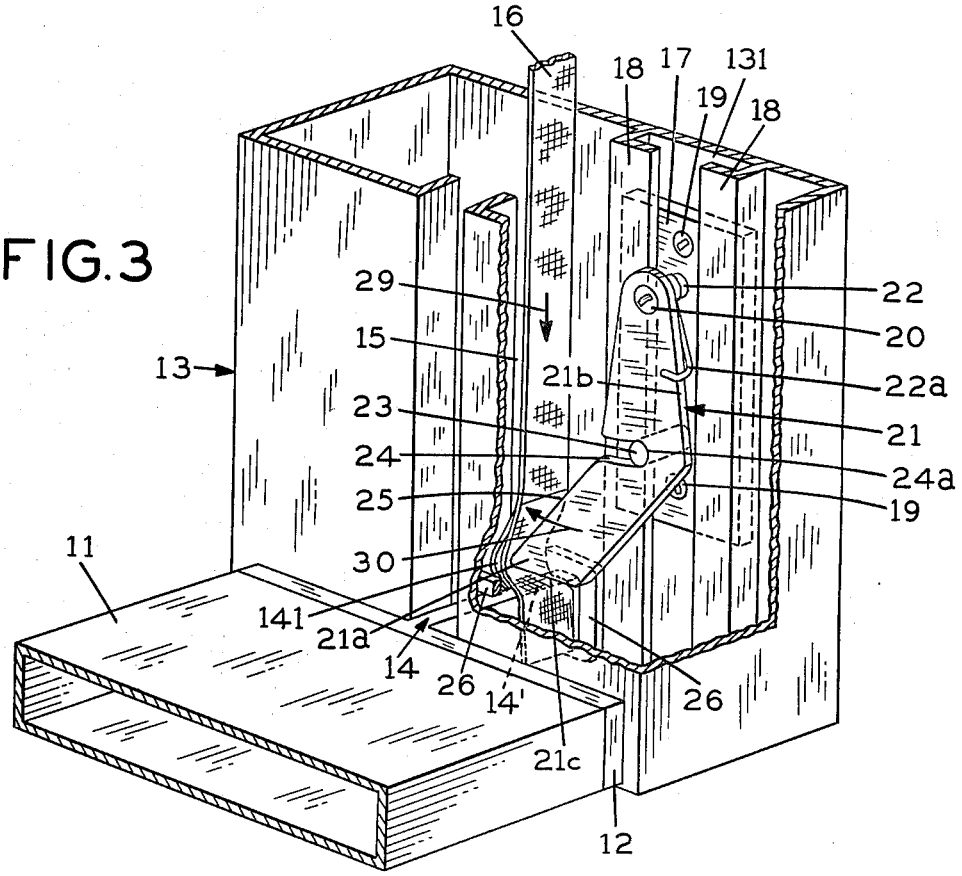
FIG. 3 is a view like FIG. 2 showing the locking mechanism in its locked position.

Having reference now to FIGS. 2 and 3 there is shown a lifting member 16 which is flexible and preferably in the form of a tape. The lifting member 16 is entirely confined within the housing 13 and at the top extends, in most installations, through the wall of the house into the interior thereof (not shown) in known manner. In this way the tape 16 may be operated from within the house to raise and lower the blind 1.

As shown in FIGS. 2 and 3, the lower end of the lifting tape 16 is entrained about the end 14' of the neck portion 14 of the end piece 12 forming a loop generally indicated at 141 positioned between two laterally extending spaced flanges 26 on the neck portion 14. In the area indicated at 142 the loop is shown stitched, adhesively or otherwise secured to itself.

Inside of the housing 13 on the side thereof opposite to the slot 15 are two "L" shaped angle members 18 secured to the adjacent wall 131 of the housing 13 by welding or any other suitable means (not shown). These angle members 18 embrace the lateral side edges of a base plate 17 dimensioned to fit slidably within the space defined by the angle members 18 and the adjacent wall 131 of the housing 13. The base plate 17 is adjustable vertically within the angle members 18 and upon suitable adjustment is secured against movement by screws 19 which pass through the base plate 17 in tapped holes therein and bear against the adjacent wall 131 of the housing 13. If desired, a series of holes (not shown) may be provided in the wall of the housing 13 in alignment with the screws 19 for engagement therewith rather than relying upon frictional engagement of the screws.

The base plate 17 carries a pivot pin 20 on the outer extremity of which is pivotally mounted the latch 21. As shown the latch 21 extends downwardly in a substantially vertical direction from the pivot pin 20. A spring 22 is loosely coiled about the pivot pin 20 and has one end thereof secured to the base plate 17 as shown at **22*b*. The opposite end of the spring 22 has a hook shape 22*a* which is engaged about the edge 21*b* of the latch 21**.

The latch 21 is slightly dog-legged in shape and at substantially the middle of the length thereof is provided with a slot 24 which slidably engages a pin 23 fixed to the base plate 17 and extending outwardly thereof between the angle members 18. The end of the slot 24 indicated at **24*a* will, under the urging of the spring 22, come up against the pin 23 thus serving as a stop mechanism for the latch 21**.

The portion of the latch 21 below the slot 24 extends not only downwardly but also transversely toward the path of travel of the neck piece 14. This lower portion of the latch 21 presents an angled cam face 25 angled as shown in the drawings for purposes hereinafter described.

OPERATION

As shown in FIG. 3 the lifting tape 16 has been relaxed, the spring 22 has urged the latch 21 in the direction of the arrow 30 such that the lower end **21*a* of the latch overlies the end 14' of the neck piece 14. It will be seen that in this position the loop 141 has been folded over somewhat on the top of the end 41' and the lower surface 21*c* has engaged the end 41' of the neck 14 with a portion of the lifting tape 16 which forms the loop 141 lying between the face 21*c* and the end 14'. In this position the venetian blind may not be raised by any forces applied upwardly to the lower rail 11**.

When it is desired to raise the blind the lifting tape 16 is pulled upwardly in the direction of the arrow 31 (see FIG. 2). This causes the tape 16 to be tensioned and the loop 141 of the tape 16 to be stretched open as in FIG.

2. In this position one surface 27 of the loop 141 serves as a cam surface to urge the latch 21 in the direction of the arrow 28 against the urging of the spring 22. This unlocks the latch from its engagement with the end 14' of the neck 14 permitting the lifting tape 16 together with the bottom rail 11 to move upwardly in the direction of the arrow 31. During this movement the end 14' will slide past the latch member 21 although the corner formed by the surface 25 and the surface 21*c* will bear against that portion of the loop 141 which is between such corner and the end 14'.

After the blind has been raised to the point where the bottom rail 11 is above the latch 21 the spring 22 will again urge the latch 21 in the direction of the arrow 30 (see FIG. 3) until the end 24*a* of the slot 24 bears against the stop pin 24. In this position the upwardly facing cam surface 25 of the latch is in the path of travel of the tape 16 and the end 14' of the neck 14. Accordingly, when the blind is then lowered the bottom edge of the end 14' of the neck 14 will engage this cam surface 25 on the latch 21 and as it slides therealong will force the latch 21 in the direction of the arrow 28 (see FIG. 2) against the urging of the spring 22. This permits the blind to be completely lowered and for the end 14' to pass beneath the terminus of the latch 21. Thereafter upon releasing the tension of the tape 16 the same will move in the direction of the arrow 29 and the latch 21 will be urged by the spring 22 in the direction of the arrow 30. This movement takes up some of the slack in the untensioned lifting tape 16 and permits the latch to move into the position shown in FIG. 3 where the blind is again locked against undesired upward movement of the rail 11.

While the locking mechanism has only been shown for one side of the blind it will be appreciated that it is preferable that a similar locking mechanism be provided for each of the two ends of the rail 11.

Various modifications are contemplated as falling within the spirit of the invention and within the appended claims. For example, the latch can be suitably shaped to be pivoted below the lowest position of the bottom rail 11 while still having the upwardly facing cam surface 25 and the downwardly facing locking or latching face 21*c*.

I claim:

1. In a locking device for a raisable venetian blind having a side housing, a bottom rail, and a flexible lifting member engaging the bottom rail for raising and lowering the same, the improvement comprising an end piece on the bottom rail extending into said housing for vertical movement with said bottom rail along a path of travel, a latch pivoted in said housing, said latch being movable between a first position in which at least a portion thereof is positioned in said vertical path of travel of said end piece and a second position in which said end piece may pass thereby, said latch being positioned to be engageable with said flexible member, and the position and movement of said latch being at least in part determined by the tension or lack thereof in said flexible member when engaged with said latch.

2. The device of claim 1 in which said flexible member has a loop at the end thereof entrained about a portion of said end piece, said loop presenting a camming surface to said latch when said flexible member is tensioned to lift the blind, said camming surface engaging said latch when said end piece is at and near its fully lowered position and said flexible member is tensioned, and said engagement of said camming surface with said latch upon upward movement of said bottom rail effecting movement of said latch portion toward said second position.

3. The device of claim 1 in which, when said end piece is in its fully lowered position and the tension in said flexible member is relaxed, said latch is in said first position with said portion overlying said end piece and said end piece is locked against upward movement by said overlying latch portion.

4. The device of claim 1 in which said portion of said latch includes a cam face; said cam face, when said latch is in said first position and said end piece is above its fully lowered position, being in alignment with and facing toward said end piece; said bottom rail and end piece applying a force to said cam face to move said latch toward said second position upon lowering of said bottom rail and end piece by said flexible member.

5. The device of claim 3 in which said portion of said latch includes a cam face; said cam face, when said latch is in said first position and said end piece is above its fully lowered position, being in alignment with and facing toward said end piece; said bottom rail and end piece applying a force to said cam face to move said latch toward said second position upon lowering of said bottom rail and end piece by said flexible member.

6. The device of claim 5 in which said flexible member has a loop at the end thereof entrained about a portion of said end piece, said loop presenting a camming surface to said latch when said flexible member is tensioned to lift the blind, said camming surface engaging said latch when said end piece is at and near its fully lowered position and said flexible member is tensioned, and said engagement of said camming surface with said latch upon upward movement of said bottom rail effecting movement of said latch portion toward said second position.

7. In a locking device for a raisable venetian blind having a side housing, a bottom rail, and a flexible lifting member engaging the bottom rail for raising and lowering the same, the improvement comprising an end piece on the bottom rail extending into said housing for vertical movement with said bottom rail along a path of travel, a latch pivoted in said housing, said latch being movable between a first position in which at least a portion thereof is positioned in said vertical path of travel of said end piece and a second position in which said end piece may pass thereby, and said latch being movable between said first and second positions upon operation of said flexible lifting member to raise or lower the blind.

* * * * *